US010386083B2

(12) United States Patent
Kasugai et al.

(10) Patent No.: US 10,386,083 B2
(45) Date of Patent: Aug. 20, 2019

(54) OUTDOOR UNIT OF AIR CONDITIONER

(71) Applicant: FUJITSU GENERAL LIMITED, Kawasaki-shi, Kanagawa-ken (JP)

(72) Inventors: Satoshi Kasugai, Kawasaki (JP); Rikio Mizuguchi, Kawasaki (JP)

(73) Assignee: FUJITSU GENERAL LIMITED, Kawasaki-shi, Kanagawa-Ken (JP)

( * ) Notice: Subject to any disclaimer, the term of this patent is extended or adjusted under 35 U.S.C. 154(b) by 109 days.

(21) Appl. No.: 15/596,725

(22) Filed: May 16, 2017

(65) Prior Publication Data

US 2017/0343224 A1 Nov. 30, 2017

(30) Foreign Application Priority Data

May 31, 2016 (JP) ..... 2016-108335

(51) Int. Cl.
*F24F 1/38* (2011.01)
*F24F 1/50* (2011.01)
*F24F 13/20* (2006.01)

(52) U.S. Cl.
CPC ..... *F24F 1/38* (2013.01); *F24F 1/50* (2013.01); *F24F 13/20* (2013.01)

(58) Field of Classification Search
CPC ..... F24F 1/58; F04D 29/526
USPC ..... 23/259.1
See application file for complete search history.

(56) References Cited

U.S. PATENT DOCUMENTS 9,273,896 B2 * 3/2016 Sao ..... F24F 1/24
2009/0193831 A1 * 8/2009 Kim ..... F04D 29/526 62/259.1
2016/0187005 A1 * 6/2016 Kwon ..... F24F 1/40 62/259.1
2019/0010960 A1 * 1/2019 Nakashima ..... F24F 1/38

FOREIGN PATENT DOCUMENTS

JP 5402987 B2 1/2014

* cited by examiner

*Primary Examiner* — Edward F Landrum
*Assistant Examiner* — Chang H. Park
(74) *Attorney, Agent, or Firm* — Manabu Kanesaka

(57) ABSTRACT

There is provided an outdoor unit of an air conditioner which receives a load which is applied to a top panel using an entirety of a housing, and the top panel and a fan guard do not easily deform. A lower end of a bell mouth is fixed to a front beam and a rear beam of the housing, and an upper end of the bell mouth is caused to come into contact with a back face of the top panel to support the load which is applied to the top panel with the bell mouth.

4 Claims, 7 Drawing Sheets

OUTDOOR UNIT OF AIR CONDITIONER

RELATED APPLICATIONS

The present application is based on, and claims priority from, Japanese Application No. JP2016-108335 filed May 31, 2016, the disclosure of which is hereby incorporated by reference herein in its entirety.

BACKGROUND OF THE INVENTION

1. Field of the Invention

The present invention relates to an outdoor unit of an air conditioner, and more particularly to an upward blow-out type outdoor unit in which a blower chamber is disposed on a top portion of a machine chamber which includes a heat exchanger and a compressor.

2. Background Art

A multi-type air conditioner in which a plurality of indoor units are connected to a single outdoor unit is an example of an air conditioner. For example, as described in Japanese Patent No. 5402987, the outdoor unit of the air conditioner includes a rectangular parallelepiped housing, and the inner portion of the housing is partitioned into a machine chamber which includes a heat exchanger and a compressor, and a blower chamber which includes a blower . The machine chamber is disposed on the bottom portion of the housing, the blower chamber is disposed on the top portion of the machine chamber, and a top panel which includes an air blowing port of the blower is provided on the top surface of the housing.

The top panel is horizontally bridged across and fixed to support columns (or left and right side panels) which are provided to stand on four corners of the housing, and a fan guard for protecting the blower is attached to the air blowing port.

However, since the top panel is supported only at the four corners, when a person stands on the top panel, when an object falls onto the top panel, or the like and a great load is applied, the top panel and the fan guard may easily deform. In particular, since the air blowing port is formed in the center of the top panel, the mechanical strength is weak, and the top panel easily flexes in the vicinity of the center portion.

SUMMARY OF THE INVENTION

An object of the present invention is to provide an outdoor unit of an air conditioner which receives a load which is applied to a top panel using an entirety of a housing, and the top panel and a fan guard do not easily deform.

One aspect of the present invention relates to an outdoor unit of an air conditioner which includes a blower and a bell mouth of the blower disposed in an inner portion of a housing, in which a top panel having an air blowing port of the blower is provided on the top surface of the housing. A lower end of the bell mouth is fixed to a frame of the housing, an upper end of the bell mouth is disposed so as to come into contact with a circumference of the air blowing port on a back face of the top panel, and a portion of a load which is applied to the top panel is supported by the bell mouth.

As a more preferable aspect, the bell mouth includes a cylindrical body portion which is disposed to surround an outer circumference of the blower, an upper flange is formed on an upper end of the body portion, and the upper flange comes into contact with the back face of the top panel.

As a still more preferable aspect, a frame of the housing includes a base panel, a left side panel and a right side panel which are disposed along a left side end and a right side end of the base panel, a front beam which is bridged between front ends of the left side panel and the right side panel, and a rear beam which is bridged between rear ends of the left side panel and the right side panel, and in which a lower end of the bell mouth is supported by the front beam and the rear beam.

According to an aspect of the present invention, by supporting a portion of the load which is applied to the top panel via the bell mouth, even if a large load such as a person or an object is applied to the top panel, the top panel and the fan guard do not deform easily.

DETAILED DESCRIPTION OF THE INVENTION

Next, description will be given of an embodiment of the present invention with reference to the drawings; however, the present invention is not limited thereto.

Figure 1:
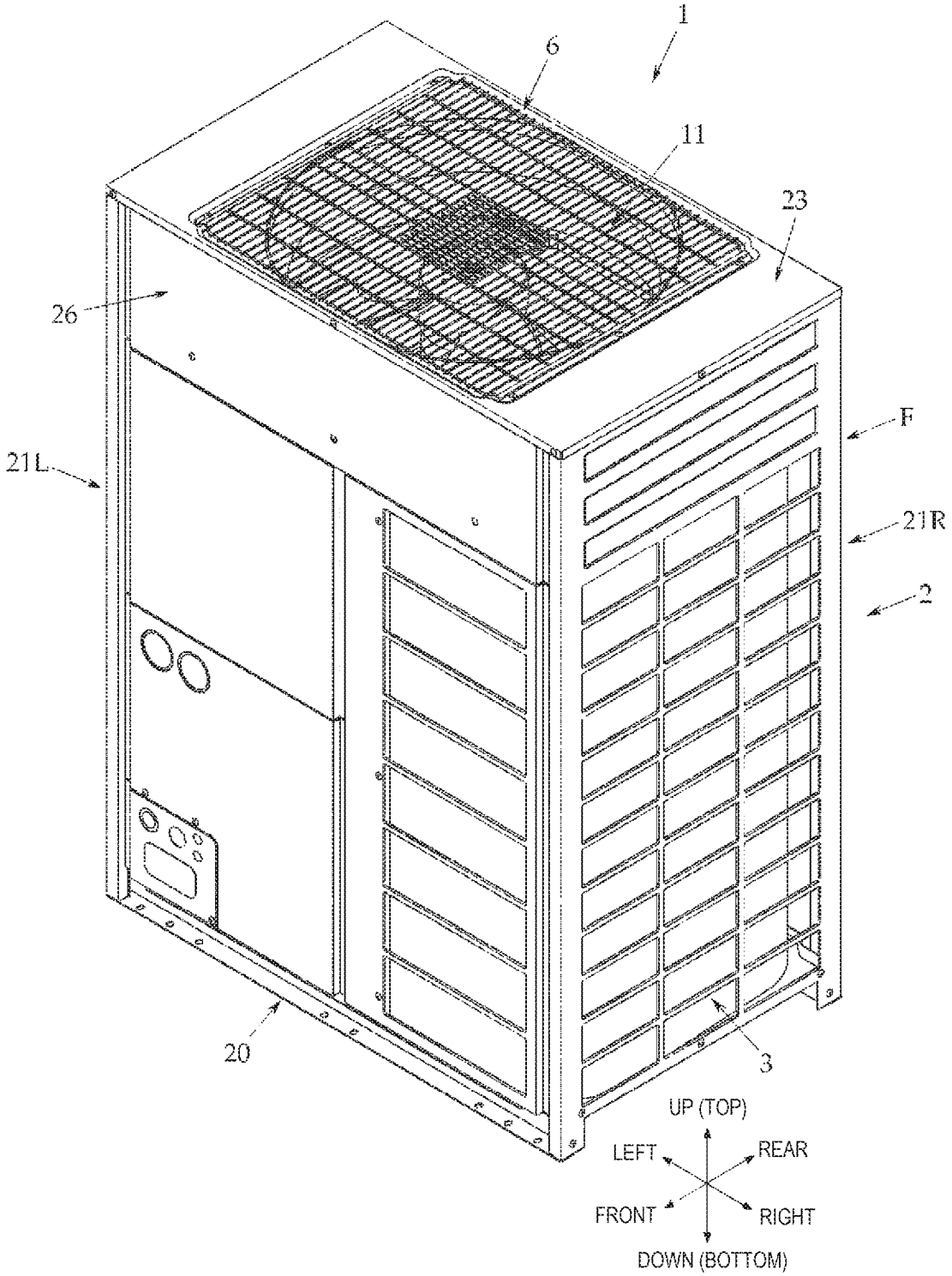
FIG. 1 is a perspective view of an outdoor unit of an air conditioner according to an embodiment of the present invention.
Figure 2:
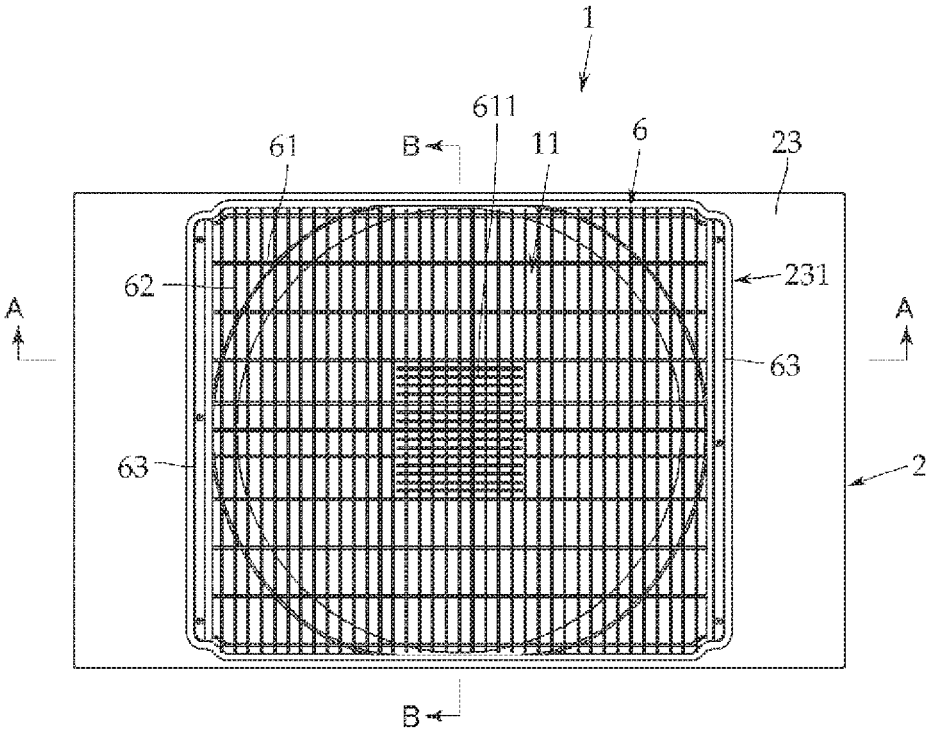
FIG. 2 is a plan view of the outdoor unit of the air conditioner.
Figure 3:
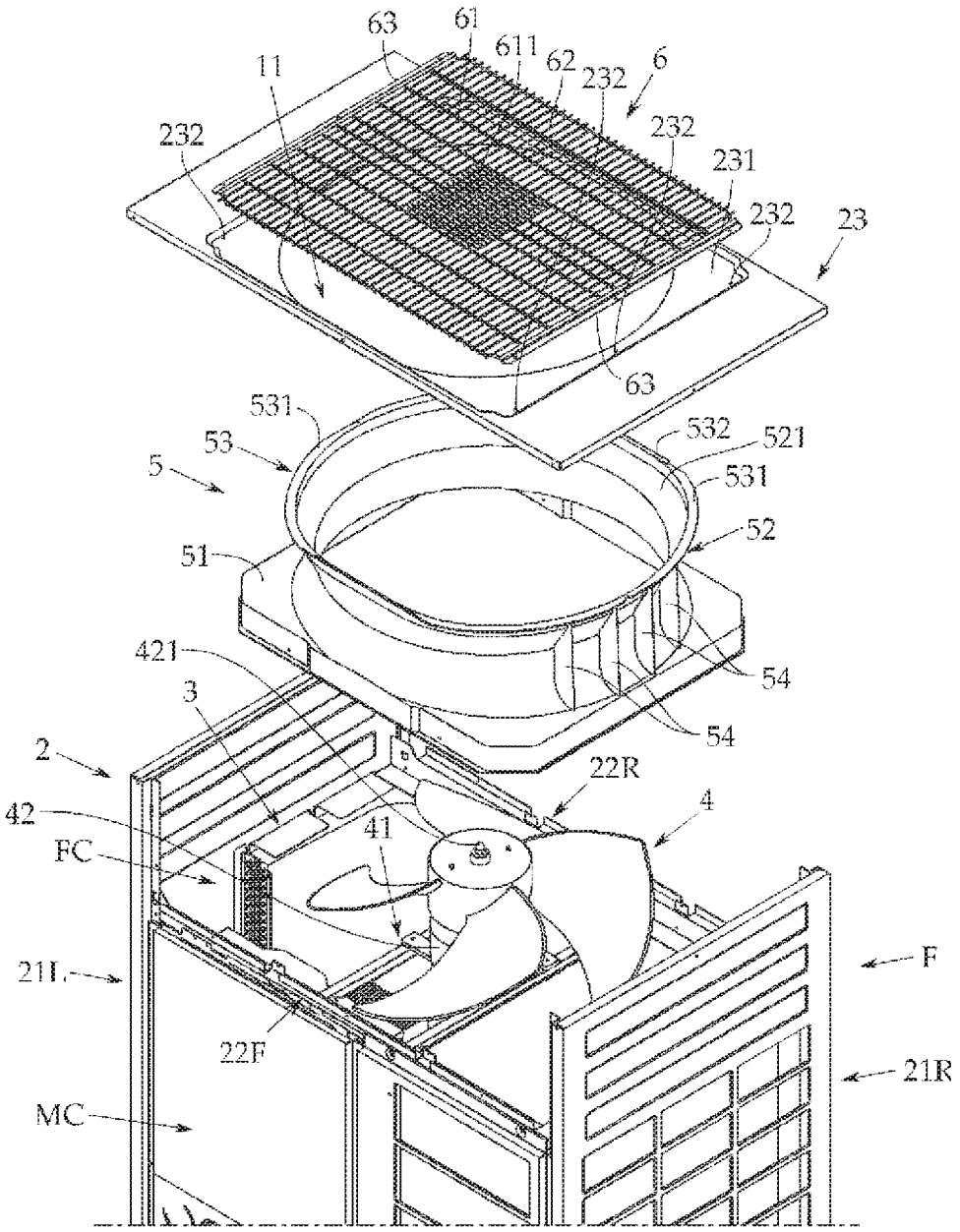
FIG. 3 is an exploded perspective view in which a portion of the outdoor unit of the air conditioner is exploded.
Figure 4:
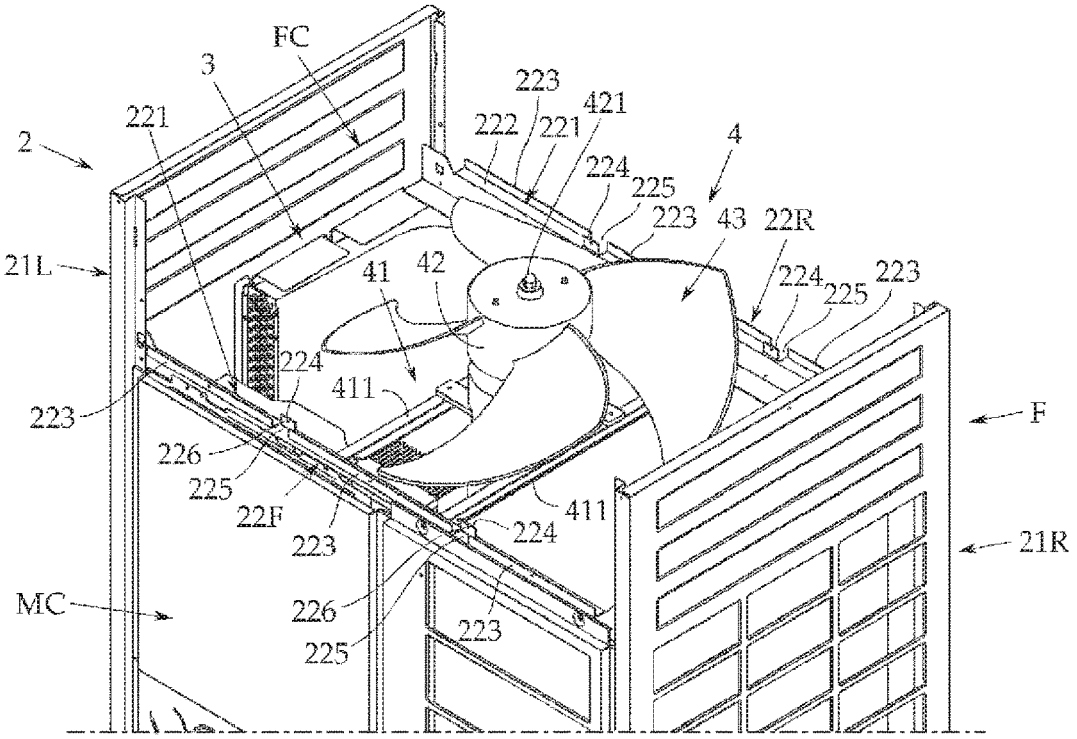
FIG. 4 is an enlarged perspective view of a blower chamber of the outdoor unit of the air conditioner.

As illustrated in FIGS. 1 to 3, an outdoor unit 1 of an air conditioner includes a rectangular parallelepiped housing 2 which is horizontally long in the left-right direction (the left-right direction in FIG. 1), and the inner portion of the housing 2 is partitioned into a machine chamber MC which includes a heat exchanger 3, a compressor, and the like (not illustrated), and a blower chamber FC which includes a blower 4. In the embodiment, the machine chamber MC is disposed on the bottom portion inside the housing 2, and the blower chamber FC is disposed above the machine chamber MC.

The housing 2 is provided with a base panel 20, a left side panel 21L, a right side panel 21R, a front beam 22F (refer to FIG. 3), and a rear beam 22R (refer to FIG. 3) as a basic frame F. The base panel 20 is installed on an installation surface and has a longitudinal shape, the left side panel 21L is provided to stand on the left side end of the base panel 20, the right side panel 21R is provided to stand on the right side end of the base panel 20, the front beam 22F is horizontally bridged between the front end of the left side panel 21L and the front end of the right side panel 21R, and the rear beam 22R is horizontally bridged between the rear end of the left side panel 21L and the rear end of the right side panel 21R.

In the embodiment, the front beam 22F and the rear beam 22R are disposed on the heat exchanger 3 of the machine chamber MC of the housing 2 to form a boundary with the blower chamber FC. The front beam 22F and the rear beam 22R are horizontally disposed to be parallel to the base panel 20 and to be parallel on the same horizontal plane as each other.

A front panel 26 is attached to the front face of the machine chamber MC of the housing 2. The front panel 26 is a horizontally long metal panel which blocks the front face of the machine chamber MC, both left and right ends of the front panel 26 are screwed to the front end of the left side panel 21L and the right side panel 21R, the upper end side is screwed to a top panel 23, and the lower end side is screwed to the front beam 22F.

A rear panel (not illustrated) which is similar to the front panel 26 is attached to the rear face side of the blower chamber FC of the housing 2. The rear panel is a horizontally long metal panel which blocks the rear face of the blower chamber FC, both left and right ends of the rear panel are screwed to the rear end of the left side panel 21L and the right side panel 21R, the upper end side of the rear panel is screwed to the top panel 23, and the lower end side is screwed to the rear beam 22R.

Figure 8A:
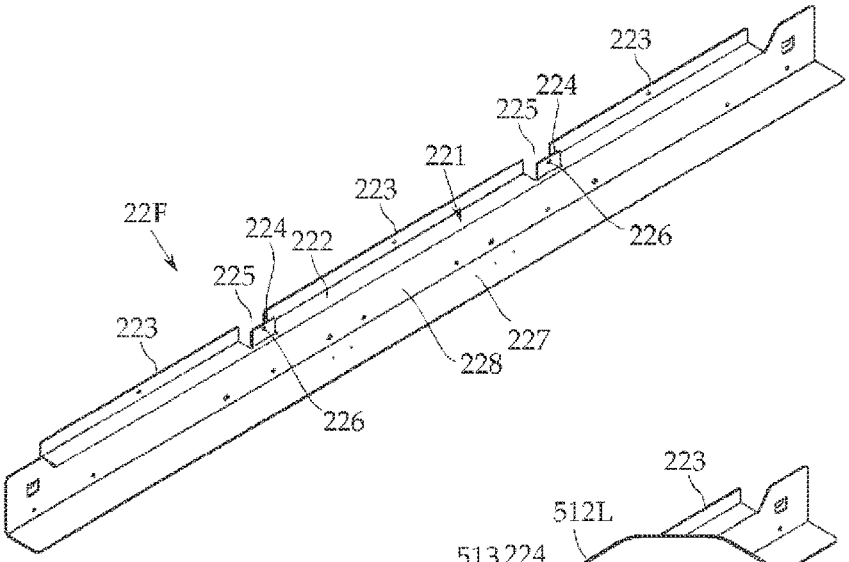
FIG. 8A is a perspective view of a front beam.
Figure 8B:
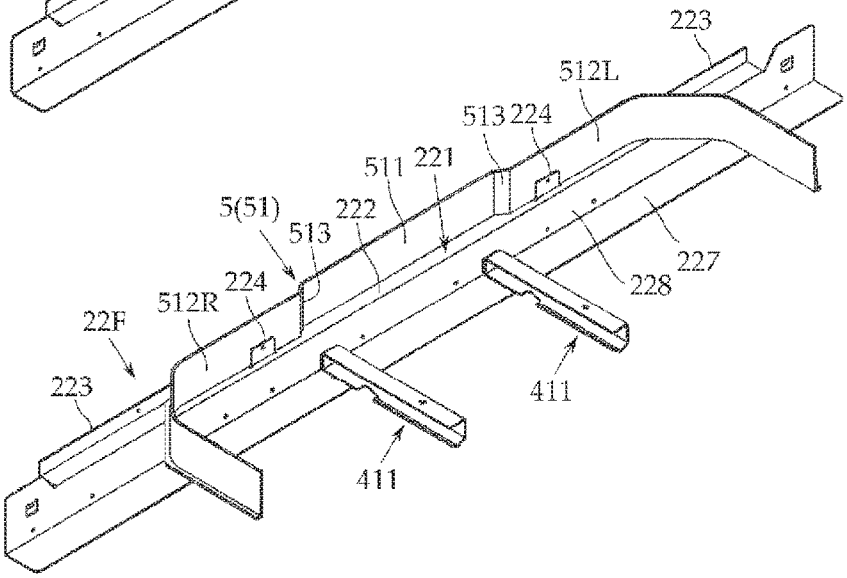
FIG. 8B is a perspective view illustrating a state in which the bell mouth is mounted on a front beam.
Figure 8C:
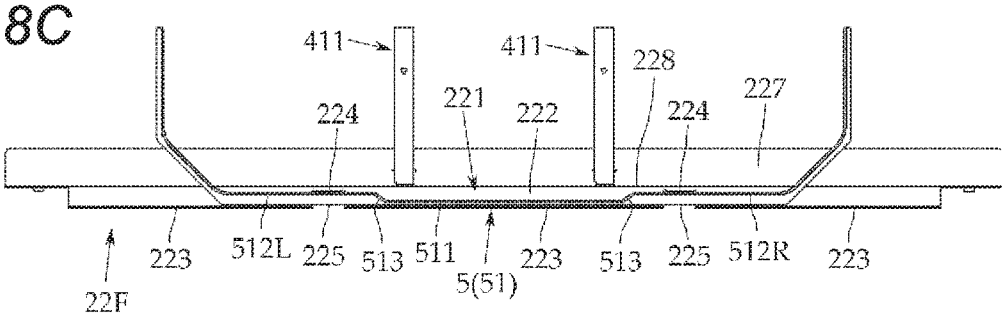
FIG. 8C is a plan view.

Since the basic structure of the front beam 22F and the rear beam 22R is the same, hereinafter description will be given of the front beam 22F. With reference to FIGS. 8A to 8C, the front beam 22F is formed in a single rail shape by press molding a single sheet of metal plate. A supporting portion 221 which supports a bell mouth 5 (described later) is formed on the upper end side of the front beam 22F. The lower end portion of the front beam 22F is bent in approximately a right angle toward the inside (the inside of the housing 2), and forms a supporting piece 227 which supports a beam member 411 of a motor bracket 41 (described later) .

The supporting portion 221 is provided with a horizontal supporting surface 222, a front face rib 223, and a rear face rib 224. The supporting surface 222 continuously extends to the left and right of the upper end of the front beam 22F, the front face rib 223 is provided to stand substantially perpendicular from the front end (the rear end in FIG. 8A) of the supporting surface 222, and the rear face rib 224 is provided to stand substantially perpendicular from the rear end (the front end in FIG. 8A) of the supporting surface 222.

The front face rib 223 is continuously formed along both left and right ends of the front beam 22F. In the embodiment, two cutout portions 225 and 225 are provided in two locations at positions so as to be left-right symmetrical interposing a rotation shaft 421 of the blower 4 of the front face rib 223.

The rear face rib 224 is disposed in two locations at positions which interpose the supporting surface 222 and face each of the cutout portions 225 and 225 of the front face rib 223, and a female screw hole 226 for screwing in the bell mouth 5 is provided by being bored into the middle of the rear face rib 224 at each location at which the rear face rib 224 is provided.

As illustrated in FIG. 8B, the motor bracket 41 on which the blower 4 is mounted is provided on the front beam 22F and the rear beam 22R. The motor bracket 41 includes a pair of beam members 411 and 411 which are bridged between the front beam 22F and the rear beam 22R in parallel. The front ends of the beam members 411 and 411 abut a rear face 228 (FIGS. 8A to 8C) of the front beam 22F, and are screwed in a state of being placed on the supporting piece 227. The rear ends of the beam members 411 and 411 are similarly screwed in a state of abutting against the rear beam.

A fan motor 42 of the blower 4 is mounted on the motor bracket 41, and a propeller fan 43 is attached to a rotation shaft 421 of the fan motor 42. The bell mouth 5 of the blower 4 is further provided in the blower chamber FC.

Figure 5:
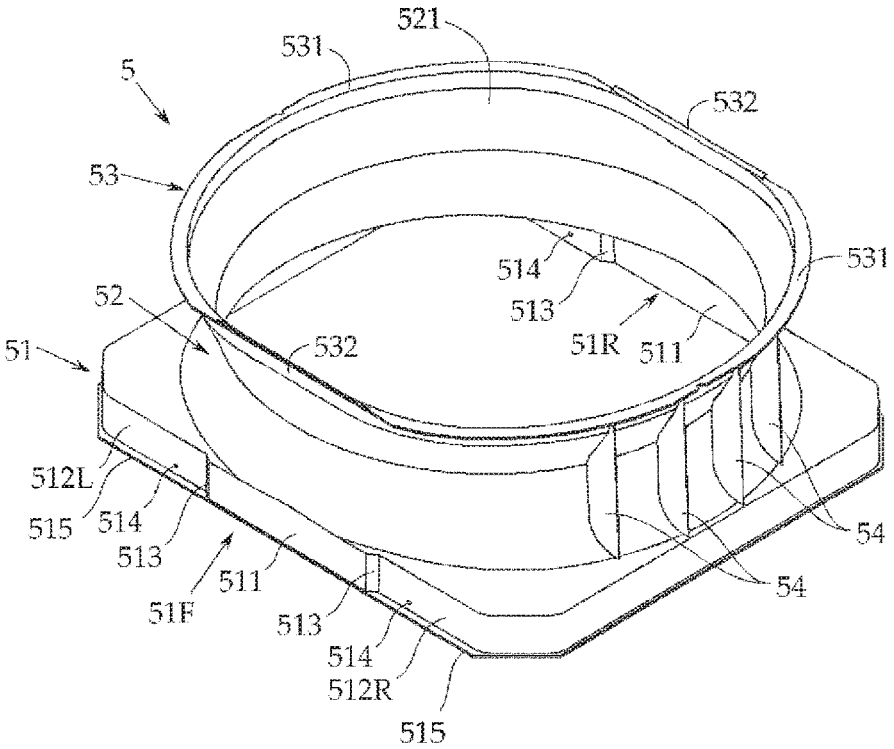
FIG. 5 is an enlarged perspective view of a bell mouth of the outdoor unit of the air conditioner.

As illustrated in FIG. 5, the bell mouth 5 includes a rectangular stand portion 51 and a cylindrical body portion 52 which is provided to protrude from the top surface of the stand portion 51 upward, and is disposed to surround the outer circumference of the propeller fan 43.

The stand portion 51 has a hollow rectangular box shape, and the lower face of the stand portion 51 is open over the full surface. Both a front wall surface 51F (the surface positioned on the front face side of the housing 2) and a rear wall surface 51R (the surface positioned on the rear face side of the housing 2) of the stand portion 51 are formed as perpendicular surfaces (surfaces which are perpendicular to the top surface of the stand portion 51) which continue along the left and right, and a center portion 511 is formed so as to overhang to the front face side from a left wall portion 512L and a right wall portion 512R via stepped surfaces 513 and 513.

The left wall portion 512L and the right wall portion 512R are provided with screw holes 514 to be screwed together with the female screw holes 226 of the rear face ribs 224 (refer to FIG. 8B). In the embodiment, the screw holes 514 are screw insertion holes, and are provided in a total of four locations, one in each of the left wall portions 512L and the right wall portion 512R of the front wall surface 51F and the left wall portions 512L and the right wall portion 512R of the rear wall surface 51R.

Figure 7:
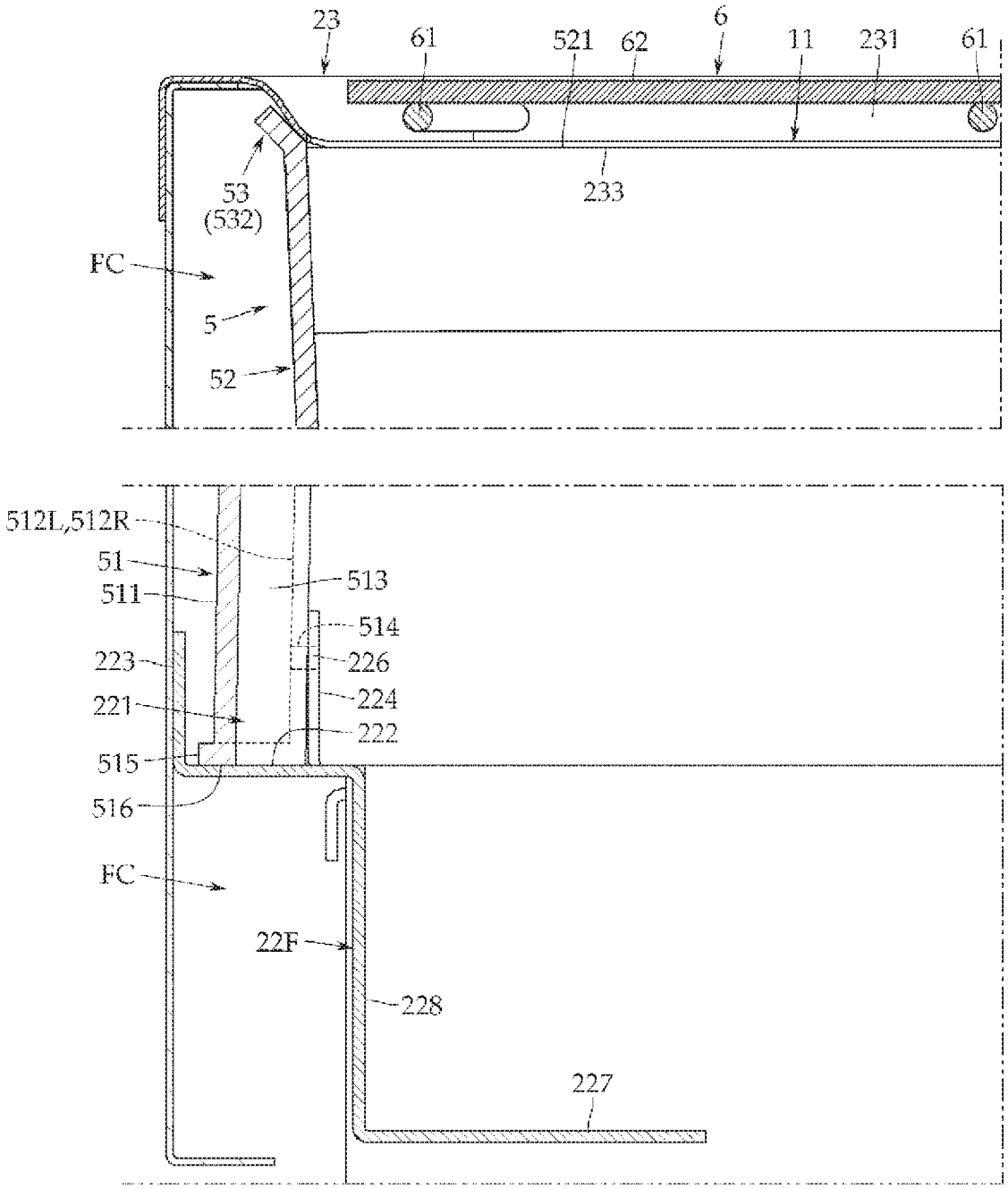
FIG. 7 is a sectional view of a B-B line portion of FIG. 2.

A lower flange 515 which extends horizontally toward the outside is formed on a lower end 516 of the stand portion 51. Accordingly, as illustrated in FIG. 7, the lower flange 515 is mounted along the supporting surface 222 of the supporting portion 221.

The body portion 52 is formed in an approximately straight cylindrical shape from the stand portion 51 to the attachment position of the propeller fan 43, and the opening diameter of the body portion 52 is formed to gradually become larger from the upper end of the propeller fan 43 toward a top end opening 521 (the top end in FIG. 3).

An upper flange 53 is formed on the top end of the body portion 52 so as to be inclined from the upper end of the body portion 52 toward the outside. In the embodiment, the upper flange 53 includes a first upper flange 531 and a second upper flange 532, and the width of the first upper flange 531 is formed bigger than the width of the second upper flange 532. The first upper flange 531 is provided to protrude toward the left-right direction (the left-right direction in FIG. 3) of the body portion 52, and the second upper flange 532 is provided to protrude toward the front-rear direction (the front-rear direction in FIG. 3) of the body portion 52.

In the embodiment, the first upper flange 531 is parallel to the top surface of the stand portion 51. As is illustrated in FIG. 7, it is difficult to render the second upper flange 532 a flange shape which is parallel to the top surface of the stand portion 51 due to the constrictions of the housing space. Therefore, the second upper flange 532 is formed to be diagonally inclined. The second upper flange 532 may have a shape with which it is possible to come into contact along a back face 233 of the top panel 23, and as long as it is possible to support the load of the top panel 23, the shape of the second upper flange 532 may be arbitrarily modified according to the specification.

The outer circumference of the side face of the body portion 52 is provided with reinforcing ribs 54 for increasing the mechanical strength of the body portion 52. The reinforcing ribs 54 are formed on the side face of the body portion 52 so as to be parallel to each other in an up-down direction, and in the embodiment, and are provided in four locations on each of the left and right side faces (a total of eight locations).

On the top surface of the housing 2 (the top surface of the blower chamber MC), the top panel 23 is bridged between the top end of the left side panel 21L and the upper end of the right side panel 21R. The top panel 23 is a metal panel which blocks the top surface of the housing 2, and an air blowing port 11 of the blower 4 is formed in the center of the top panel 23.

Figure 6:
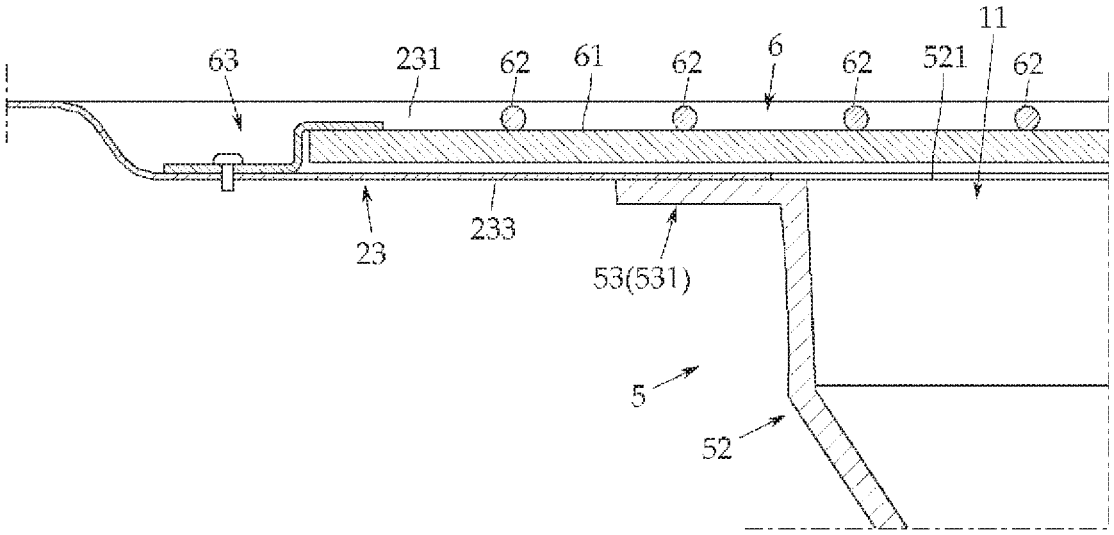
FIG. 6 is a sectional view taken along an A-A line portion of FIG. 2.

The air blowing port 11 is formed to match the top end opening 521 of the body portion 52, as illustrated in FIGS. 6 and 7, the upper flange 53 of the body portion 52 is configured to come into contact with the rear face (the back face 233) of the top panel 23.

As illustrated in FIG. 3, a fan guard attachment portion 231 to which a fan guard 6 (described later) is screwed is provided on the top panel 23. The fan guard attachment portion 231 is a concave portion which is formed a level lower to match the outer shape of the fan guard 6 from the top surface of the top panel 23 in the periphery of the air blowing port 11. In the embodiment, screw holes 232 are provided in three locations on each of the left and right sides of the fan guard attachment portion 231.

Also referring to FIG. 6, the fan guard attachment portion 231 is formed such that the depth thereof is greater (deeper) than the thickness of the fan guard 6, and the fan guard 6 is stored inside the fan guard attachment portion 231 so as not to protrude from the surface of the top panel 23 to the outside.

Next, as is illustrated in FIG. 6, the fan guard 6 includes a lateral rail portion 61, a longitudinal rail portion 62, and a left-right pair of fixing plates 63. The lateral rail portion 61 extends in the left-right direction of the top panel 23 and is formed from a plurality of wire rods which are disposed parallel to each other at a predetermined interval, the longitudinal rail portion 62 extends in the front-rear direction of the top panel 23 and is formed from a plurality of wire rods which are disposed parallel to each other at a predetermined interval, and the fixing plates 63 continuously extend from the front end to the rear end of both left and right end portions of the lateral rail portion 61.

In the embodiment, the lateral rail portion 61 and the longitudinal rail portion 62 are both formed from plastic coated wire rods (soft steel wire rods, the surfaces of which are coated with a polyvinyl chloride resin) and are designed such that the diameter of the wire rods of the lateral rail portion 61 is greater than the diameter of the wire rods of the longitudinal rail portion 62. Accordingly, it is possible to increase the mechanical strength of the fan guard 6, and it is possible to prevent deformation of the fan guard 6.

As illustrated in FIG. 6, the longitudinal rail portion 62 is disposed on the top surface of (above in FIG. 6) the lateral rail portion 61, and after welding the intersecting portions of the longitudinal rail portion 62 and the lateral rail portion 61, the surfaces thereof are coated with a vinyl chloride resin. The fixing method, the fixing locations, and the coating process of the lateral rail portion 61 and the longitudinal rail portion 62 are arbitrarily modifiable according to the specifications.

In the embodiment, auxiliary rail portions 611 are provided on the center portion of the fan guard 6 parallel along the lateral rail portion 61 and at a predetermined interval between the wire rods of the lateral rail portion 61. Although blown air does not leave from the center portion of the propeller fan 43, there is a case in which a vortex is generated. The auxiliary rail portion 611 is provided in order to suppress the occurrence of a vortex.

Next, with reference to FIG. 7 and FIGS. 8A to 8C, in order to attach the bell mouth 5 to the housing 2, place the lower flange 515 of the stand portion 51 of the bell mouth 5 on the top of each of the supporting portions 221 of the front beam 22F and the rear beam 22R, subsequently align the screw holes 514 which are provided in the left and right wall portions 512 with the screw holes 226 of the rear face rib 224, and subsequently fix the bell mouth 5 to the housing 2 using screws (not illustrated).

Next, by screwing both ends of the top panel 23 into the side panels 21L and 21R after bridging the top panel 23 over the upper end of the left side panel 21L of the housing 2 to the top end of the right side panel 21R, the upper flange 53 of the bell mouth 5 comes into contact with the back face 233 (the lower face in FIG. 7) of the top panel 23 along the outer circumference of the air blowing port 11.

Accordingly, the top panel 23 supports not only the left side panel 21L and the right side panel 21R, but also comes into contact with and supports the upper end of the bell mouth 5 with the periphery of the air blowing port 11 of the top panel 23, and it is possible to support the load which is applied to the top panel 23 using the housing 2 by fixing the lower end of the bell mouth 5 to the front beam 22F and the rear beam 22R which are a frame F of the housing 2.

As described above, according to the present invention, by supporting the load which is applied to the top panel via the bell mouth using the housing, even if a large load such as a person or an object is applied to the top panel, the top panel and the fan guard do not deform easily.

What is claimed is:

1. An outdoor unit of an air conditioner comprising:

a blower;

a bell mouth including a stand portion having a rectangular hollow box shape, the stand portion including a top surface, front and rear wall surfaces extending perpendicularly from the top surface and facing each other, and left and right wall surfaces connecting the front and rear wall surfaces and extending perpendicularly from the top surface to face each other, and a cylindrical body portion extending upwardly from the top surface of the stand portion and surrounding an outer circumference of the blower, the cylindrical body portion including an upper flange formed on an upper end thereof, and reinforcing ribs provided on two side faces of the cylindrical body portion on sides of the left and right wall surfaces of the stand portion, respectively, and excluding a front face of the cylindrical body portion on a side of the front wall surface of the stand portion and a rear face of the cylindrical body portion on a side of the rear wall surface of the stand portion, the reinforcing ribs extending parallel to each other in an up-down direction of the cylindrical body portion;

a housing accommodating the blower and the bell mouth, the housing including a frame to which the stand portion of the bell mouth is mounted, the frame including a base panel, a left side panel and a right side panel disposed along a left side end and a right side end of the base panel, respectively, a front beam bridged between front ends of the left side panel and the right side panel to support the front wall surface, and a rear beam bridged between rear ends of the left side panel and the right side panel to support the rear wall surface; and a top panel provided on a top surface of the housing, the top panel having an air blowing port for the blower, wherein the upper flange of the bell mouth contacts a circumference of the air blowing port on a back face of the top panel.

2. The outdoor unit of an air conditioner according to claim 1 , wherein the upper flange includes a pair of first upper flanges extending outwardly in a radial direction of the cylindrical body portion and arranged opposite to each other in respect to the blower; and a pair of second upper flanges inclined upwardly in respect to the pair of first upper flanges, each flange of the pair of second upper flanges being arranged between the pair of first upper flanges and connected to the pair of first upper flanges, and the pair of first upper flanges and the pair of second upper flanges contact the back face of the top panel to support the portion of the load applied to the top panel.

3. The outdoor unit of an air conditioner according to claim 2, wherein the reinforcing ribs extend from each of the pair of first upper flanges to the stand portion.

4. The outdoor unit of an air conditioner according to claim 2, wherein the top panel further includes an inclined portion formed around the circumference of the air blowing port and inclined downwardly from an upper surface thereof, parts of the inclined portion corresponding to the pair of second upper flanges directly contacting the pair of second upper flanges so that the back face of the top panel is supported by the pair of second upper flanges.

* * * * *